US005987661A

United States Patent [19]

Peterson

[11] Patent Number: 5,987,661

[45] Date of Patent: Nov. 23, 1999

[54] INFLATABLE SWIMMING POOL AND SUPPORTING NET

[75] Inventor: Leroy L. Peterson, Omaha, Nebr.

[73] Assignee: Sportsstuff, Inc., Omaha, Nebr.

[21] Appl. No.: 09/104,468

[22] Filed: Jun. 25, 1998

[51] Int. Cl.[6] ..... E04H 4/00

[52] U.S. Cl. ..... 4/506; 4/488

[58] Field of Search ..... 4/506, 496, 488, 4/487; 441/40, 66, 131

[56] References Cited

U.S. PATENT DOCUMENTS

| | | | |
|---|---|---|---|
| 3,574,244 | 4/1971 | Huss | 441/40 |
| 4,828,520 | 5/1989 | Baughman et al. | 441/40 |
| 4,935,970 | 6/1990 | Aristone | 4/506 |
| 5,383,804 | 1/1995 | Mitch et al. | 441/66 |

*Primary Examiner*—David J. Walczak
*Attorney, Agent, or Firm*—Henderson & Sturm

[57] ABSTRACT

An inflatable swimming pool fabricated from polyvinylchloride or similar materials, and having supporting netting, preferably fabricated from a tough, durable synthetic such as nylon cord. The netting is disposed under the floor of the pool and extends over the outside vertical side wall of the pool to provide support against deformation when the pool is filled with water. A safety cover, fabricated from nylon, includes a number of hooks that attach to the upper cord of the netting to secure the cover in position when the pool is not in use.

5 Claims, 3 Drawing Sheets

INFLATABLE SWIMMING POOL AND SUPPORTING NET

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

AUTHORIZATION PURSUANT TO 37 C.F.R. § 1.71(d)(e)

A portion of the disclosure of this patent document, including appendices, may contain material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

1. Field of the Invention

The present invention relates to the field of inflatable swimming pools, and more particulary to an inflatable swimming pool and supporting net for surrounding an inflatable swimming pool for improved support.

2. Description of Related Art

Inflatable swimming pools are well known in the art and generally comprise an inflatable ring with a flooring sealed to the ring around its lower edge and typically fabricated from various plastics, such as polyvinylchloride (PVC). With the increasing costs of in-ground concrete swimming pools, however, larger above-ground pools with increased depth have become more popular. Inflatable pools, however, have heretofore been unsuitable with the increased depth due to the tremendous increase in water pressure on the sides of the pool which causes the walls to deform and tear. This has lead to above-ground pools with wooden or metal superstructures generally supporting a plastic liner which is more expensive and more difficult to assemble, disassemble and store.

Those concerned with these and other problems recognize the need for an improved inflatable swimming pool.

BRIEF SUMMARY OF THE INVENTION

The present invention discloses an inflatable swimming pool fabricated from polyvinylchloride or similar materials, and having supporting netting, preferably fabricated from a tough, durable synthetic such as nylon cord. The netting is disposed under the floor of the pool and extends over the outside vertical side wall of the pool to provide support against deformation when the pool is filled with water. A safety cover, fabricated from nylon, includes a number of hooks that attach to the upper cord of the netting to secure the cover in position when the pool is not in use.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
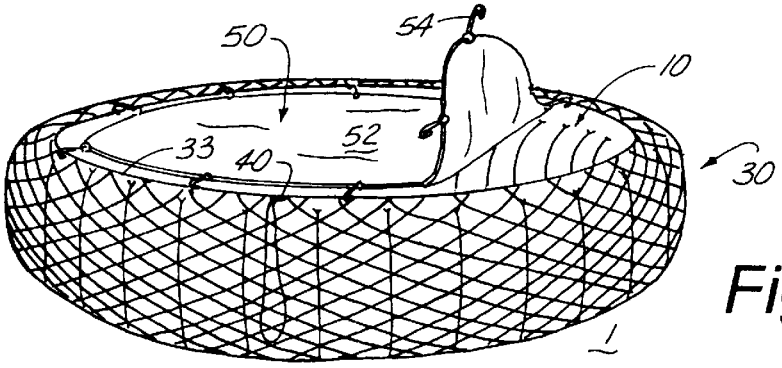
FIG. 1 is a perspective view of an inflatable pool and supporting netting with the safety cover in the process of being fully secured to the netting.

As can be seen by reference to the drawings, and in particularly to FIG. 1, the present invention is designated generally by the reference number 1. FIG. 1 shows the inflatable swimming pool 10 received in the supporting netting 30, with the safety cover 50 partially secured to the netting 30.

Figure 2:
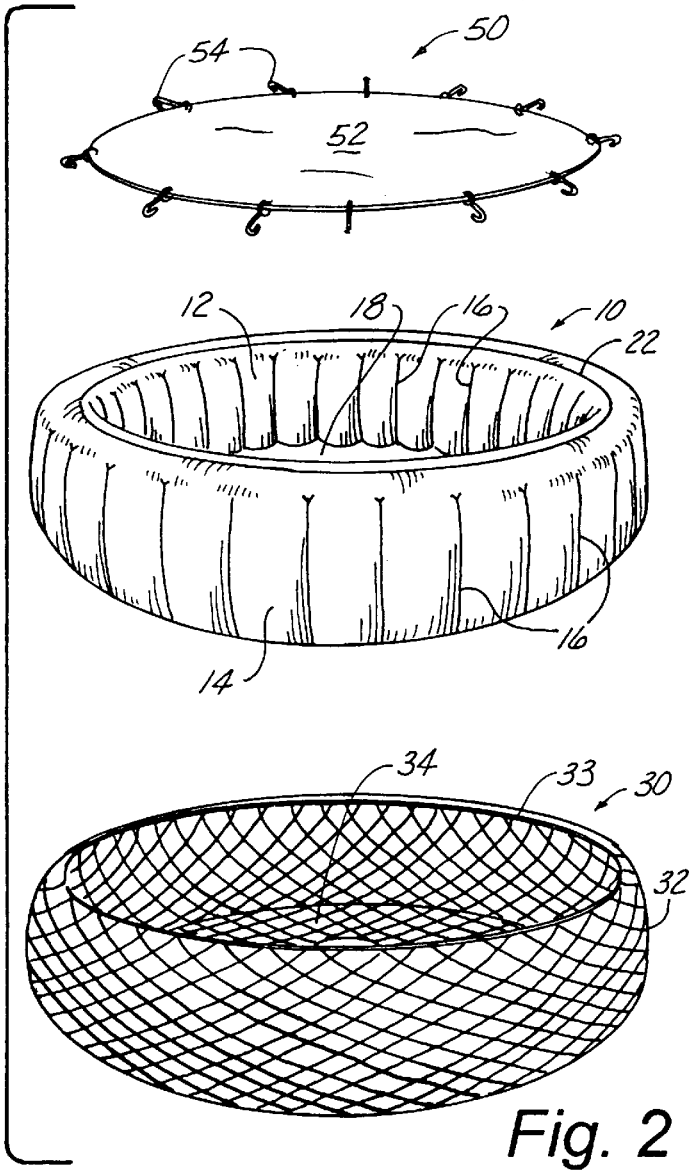
FIG. 2 is an exploded perspective view showing the netting, the pool, and the cover in their relative assembled positions.
Figure 4:
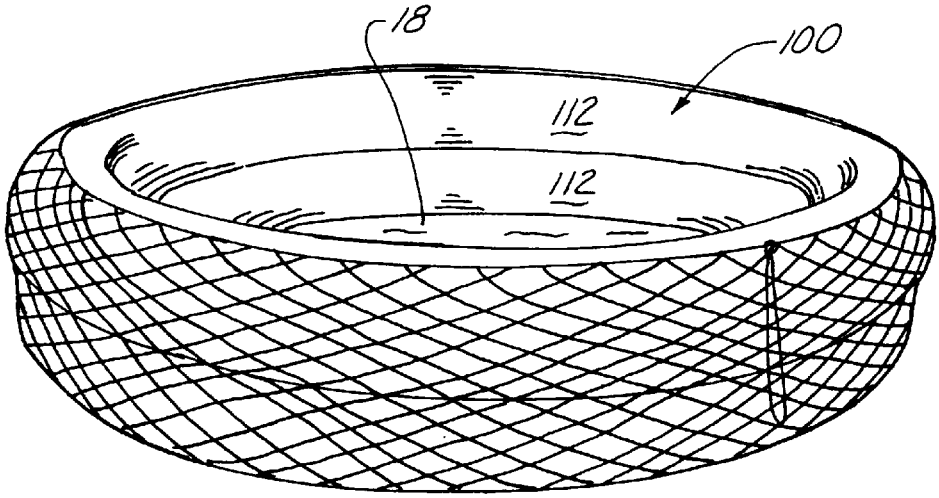
FIG. 4 is a perspective view of another style of inflatable pool and the supporting netting.
Figure 5:
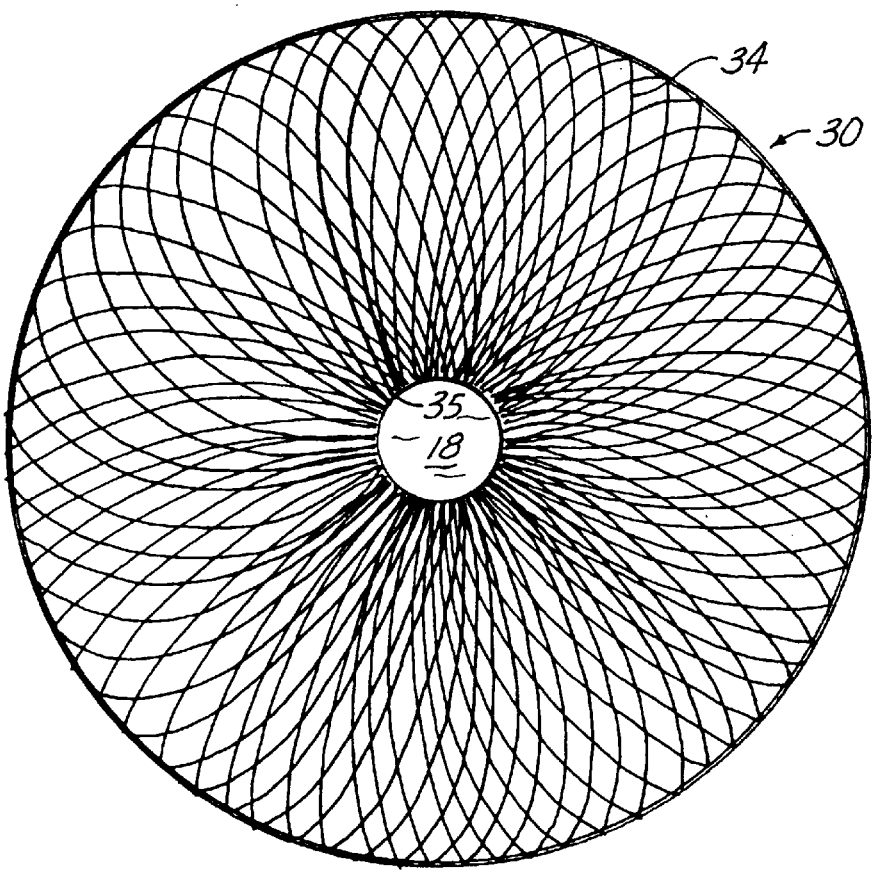
FIG. 5 is a bottom plan view of the netting covering the exterior floor of a swimming pool.
Figure 6:
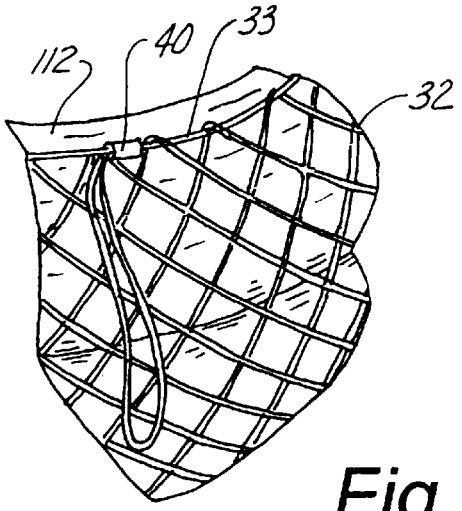
FIG. 6 is an enlarged partial perspective view illustrating the size adjustment for the upper cord of the netting.
Figure 7:
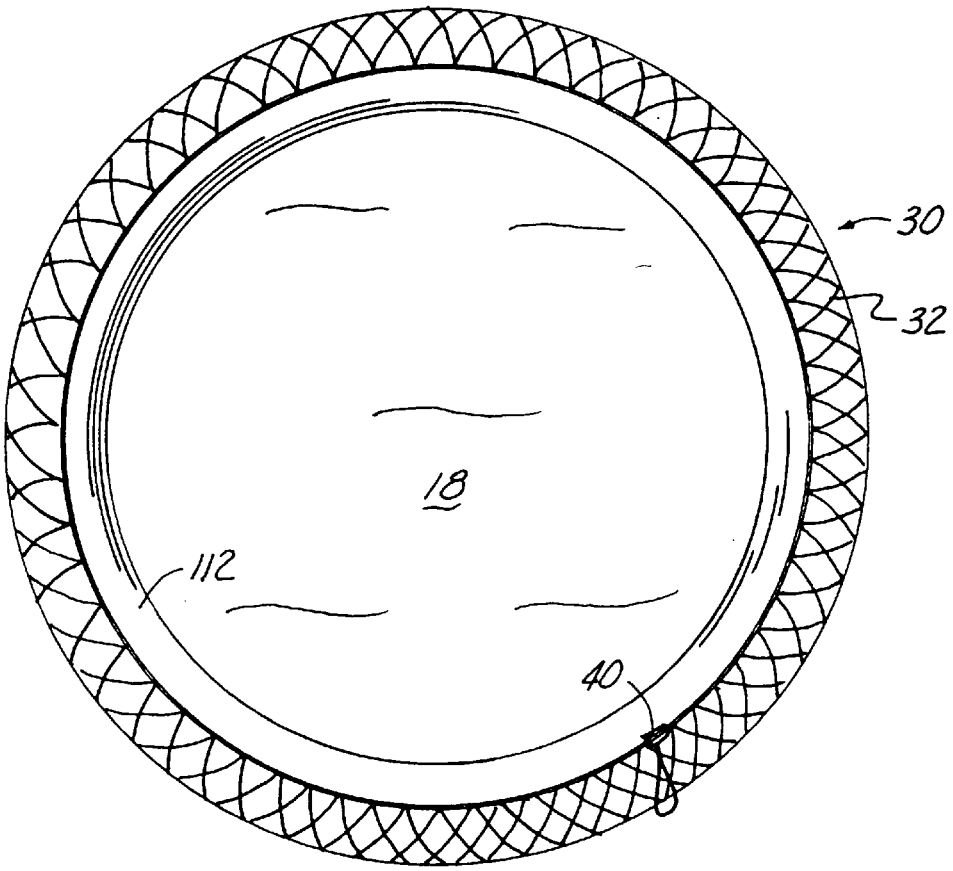
FIG. 7 is a top plan view showing the netting covering part of the upper edge of the swimming pool side wall.

As best shown in FIG. 2, the swimming pool 10 is formed of polyvinylchloride (PVC) material including an inner vertical side wall 12, an outer vertical side wall 14, a plurality of interconnecting vertical support webs 16, and a floor 18, all being secured together by thermo-welding. The inner side wall 12 and the outer side wall 14 are formed of concentric rings of material attached at their top edges 22 and their bottom edges. The vertical support web 16 extends radially in the annular cavity between the inner and outer side walls 12, 14 at spaced intervals of approximately 15° to form a series of I-beam supports. The interior annular cavity is defined by the spacing between the side walls 12, 14 when the pool 10 is inflated. Inflation of the pool 10 is done through an air valve (not shown) formed in one of the side walls 12, 14.

The supporting webs 16 do not extend to the top and bottom edges so that air admitted through the air valve communicates with all points around the circumference of the annular cavity. As shown in FIG. 2, slight vertical indentations in the exterior surface of the inner and outer side walls 12, 14 correspond to the location of the interior support webs 16. The support webs 16 forming the I-beam support columns provide increased strength to the inflated pool 10 so that water of greater depths can be supported within the pool 10 before the side walls 12, 14 deform.

The support netting 30, as best shown in FIGS. 2–7, includes a side wall supporting section 32 and a bottom section 34. The netting 30 is preferably made of durable fabric such as nylon cord. The side wall supporting section envelops the outer side wall 14 and includes top cord 33. The top cord 33 is received in a slip ring 40 (FIG. 6) to adjust the size of the top cord 33 to correspond to the top edge 22 of the side walls 12, 14. The bottom section 34 extends under the floor 18 of the pool 10 converging to a central ring 35.

Figure 3:
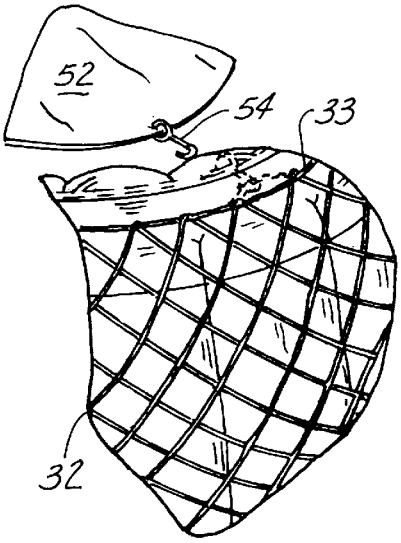
FIG. 3 is an enlarged partial perspective view illustrating one of the hooks on the cover as it engages the upper cord of the netting (dashed line)

The safety cover 50 is made of a suitable fabric such as nylon. The cover 50 includes a flat circular sheet 52 having a number of hooks 54 at spaced intervals. The sheet 52 is sized to extend over the side walls 12, 14. As shown in FIG. 3, when the cover 50 is in position, the hooks 54 on the edge of the sheet 52 engage the top cord 33 of the netting 30 to secure the cover 50 in position.

FIGS. 4–7 illustrate the support netting 30 used with an inflatable pool 110 where the side walls are formed by stacked rings 112. It is to be understood that the netting 30 can be used to support inflatable pools of other constructions not illustrated herein.

To assemble, the pool 10 or 110 is first partially inflated. It is then placed within the supporting netting 30 and fully inflated to provide a tight fit between the pool 10 or 110 and the netting 30. The top cord 33 of the netting 30 is then tightened by pulling it through the slip ring 40. The pool 10 or 110 is then filled with water to the desired depth. The support netting 30 provides support to allow for water at even greater depths. The safety cover 50 is secured in position when the pool 10 or 110 is not in use.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An inflatable swimming pool, comprising:

a side wall formed by a ring of flexible material, the side wall having an upper edge and a lower edge, the side wall defining a central open area;

a floor attached near the lower edge of the side wall, the floor being disposed to extend over a lower end of the central open area to form an open top container for receiving water; and a supporting net including a first side wall supporting section disposed to receive and support the side wall, and a second bottom section attached to the first section and disposed to extend between opposing sides of the first section.

2. The inflatable swimming pool of claim 1 wherein the net includes a top cord and a bottom central ring interconnected by intermediate cords.

3. The inflatable swimming pool of claim 2 further including a removable safety cover releasably attached to the netting.

4. The inflatable swimming pool of claim 3 wherein the top cord of the net is engaged by hooks attached to the safety cover.

5. The inflatable swimming pool of claim 1 further including a removable safety cover releasably attached to the netting.

* * * * *